US007996938B1

(12) United States Patent
Calmes et al.

(10) Patent No.: US 7,996,938 B1
(45) Date of Patent: Aug. 16, 2011

(54) BED COVER LIFT

(76) Inventors: Robert L. Calmes, Rocklin, CA (US); George W. Burger, Rocklin, CA (US)

( * ) Notice: Subject to any disclaimer, the term of this patent is extended or adjusted under 35 U.S.C. 154(b) by 0 days.

(21) Appl. No.: 12/660,270

(22) Filed: Feb. 23, 2010

(51) Int. Cl.
*A47C 21/00* (2006.01)

(52) U.S. Cl. ..... 5/505.1; 5/504.1

(58) Field of Classification Search ..... 5/505.1, 5/504.1, 503.1, 658, 659
See application file for complete search history.

(56) References Cited

U.S. PATENT DOCUMENTS

| | | | | |
|---|---|---|---|---|
| 2,598,295 | A * | 5/1952 | Pelton | 5/505.1 |
| 3,808,614 | A | 5/1974 | Reinhard | |
| 5,881,406 | A | 3/1999 | Cobb | |
| 6,240,581 | B1 | 6/2001 | Pender | |
| 6,895,615 | B2 | 5/2005 | Dilascio | |
| 6,901,616 | B1 | 6/2005 | Warrington | |
| 7,137,159 | B1 | 11/2006 | Choate | |
| 2009/0025181 | A1 | 1/2009 | Burger | |

* cited by examiner

*Primary Examiner* — Fredrick Conley
(74) *Attorney, Agent, or Firm* — Heisler & Associates

(57) ABSTRACT

The lift is attachable to a foot end of a bed beneath a mattress. Elongate arms extend up from a base portion of the lift. Sheets or other bed covers are supported above an upper end of the elongate arms to define a clearance space beneath the upper ends of the elongate arms. The elongate arms are preferably provided as a pair of first arms and a pair of second arms which can be moved from a lowered position to a raised position by action of a driver. When the arms are raised the clearance space keeps the bed covers off of feet of a user resting on the bed.

13 Claims, 5 Drawing Sheets

BED COVER LIFT

FIELD OF THE INVENTION

The following invention relates to bed sheet support and positioning apparatuses. More particularly, this invention relates to bed cover lifts which can lift the bed covers, including sheets, blankets and the like, to provide clearance beneath the bed covers and above a mattress, especially adjacent a foot of the bed. Such bed covers, once lifted, allow a user of the bed to sleep on the user's back with the feet pointing upwards and without sheets or other bed covers contacting the feet of the user.

BACKGROUND OF THE INVENTION

Often bed covers are used over a mattress of a bed so that a user of the bed can sleep under the bed covers when resting upon the mattress. Such bed covers typically include a sheet and blanket, and often multiple such blankets. To keep warm, it is desirable to have the bed covers held to the bed, typically by tucking ends of the bed covers, other than those at the head end of the bed, under the mattress. In this way, air under the bed covers is substantially trapped and can warm up somewhat and provide an insulative effect to keep the space beneath the bed covers warm.

On beds with a smaller mattress, or where the user is particularly tall, the user's feet are near the foot end of the bed. When the bed covers, especially the sheet, are tucked under the mattress tightly at the foot end of the bed, the user can have difficulty sleeping on the user's back with the toes of the user's feet pointing upwards. Insufficient clearance space is provided for the feet to extend upwardly in such an orientation. Hence, users often have to resort to sleeping on their sides or stomach, or otherwise transitioning to a less than optimal body position.

One optional solution to this problem is for the user to loosen the sheets sufficiently so that the feet can still point upwards and the sheet merely is routed up over the toes of the feet. In such a configuration the sheet and bed covers provide a significant amount of pressure down on the toes of the feet of the user. For some users, such weight of the bed covers on the toes of the feet can be uncomfortable or even painful. Such pain and discomfort can lead to disruption of sleep. For certain individuals, such as those suffering from neurological conditions that cause the toes of the feet to be particularly sensitive, or who are recovering from injuries involving the feet, the pain associated with sheets contacting the toes can be severe.

Accordingly, a need exists for a lifting device which can lift the bed covers adjacent the foot of the bed up sufficient to provide a clearance space beneath the bed covers and above the mattress, so that the feet of the user can be in any orientation without impacting the bed covers. Such a lift would beneficially be deployable and retractable between a raised position and a lowered position so that the bed covers can remain flat on the mattress when the user is not sleeping. Then, when the user comes to sleep in the bed, the lift can be activated to elevate the bed covers adjacent the foot of the bed from the lowered position to the raised position and the user can then enjoy sleeping on the bed with clearance for the user's feet.

SUMMARY OF THE INVENTION

With this invention a lift is provided for bed covers which is locatable adjacent the foot of the bed and which lifts the bed covers to provide a clearance space adjacent the foot of the bed for a user's feet. The lift is preferably simply and temporarily mounted to the foot of the bed, such as by having a base plate extending between a mattress and a box spring or other underlying mattress support. A bracket is coupled to the base plate, typically elevated somewhat above the base plate by columns which extend upward adjacent the foot of the bed. In a preferred embodiment, the brackets support a pair of first arms and a pair of second arms.

A driver is preferably provided which can transition the arms from a lowered position to a raised position. The driver is preferably configured so that it includes a spring which can store energy and then release energy to elevate the arms from the lowered position to the raised position. Rods extend between distal ends of each pair of arms in a horizontal fashion. The arms are elevated to slightly different laterally spaced positions, so that a relatively large clearance space is provided beneath the bed covers and above the mattress.

In one form of the invention, the driver is elongate in form and extends between the two brackets. Each of the arms is fitted with a rack gear. Spur gears are coupled to output shafts at each end of the driver. These spur gears interact with the rack gears of the first arms and second arms. Thus, when the output shafts of the driver turn, the pairs of arms are each caused to be elevated and in turn lift any bed covers overlying the arms.

A clip is preferably provided adjacent the brackets which can hold a foot end of the bed covers adjacent thereto. In this way, the bed covers are prevented from being separated from the mattress when lifted by the elongate arms. The lift is reversible, such as by pushing down on at least one of the elongate arms so that the rack gear of the associated arm causes the associated spur gear to turn and output shaft to turn so that the spring within the driver is converted into an energy storage mode as the at least one arm is lowered. A driver disabler or other locking device can then be utilized to keep the arms in their lowered position until it is again desired to raise the bed covers.

OBJECTS OF THE INVENTION

Accordingly, a primary object of the present invention is to provide a lift for bed covers which can elevate the bed covers adjacent the foot of a bed above a mattress to provide a clearance space above the mattress and below the bed covers.

Another object of the present invention is to provide a bed cover lift which can be transitioned from a lowered position to a raised position with the raised position elevating bed covers overlying the lift to a position higher than when the lift is in the lowered position.

Another object of the present invention is to provide a method for raising bed covers adjacent a foot of a bed.

Another object of the present invention is to provide a method for treating physiological conditions where one's toes are sensitive to pressure thereon while allowing the patient to sleep on the patient's back and still utilize bed covers without the bed covers contacting feet of the patient.

Another object of the present invention is to provide a bed cover lift which is removably attachable to a bed so the bed covers associated with the bed can be elevated above a clearance space over a mattress sufficient to allow feet of the user to be oriented pointing upwardly without coming into contact with the bed covers.

Another object of the present invention is to provide a bed cover lift which lifts at least enough of the bed covers for a single user to have clearance for feet of the user beneath the bed covers and above a mattress.

Another object of the present invention is to provide a device for lifting bed covers so that a patient or other individual can rest upon the bed without feet of the patient being contacted by the bed covers.

Other further objects of the present invention will become apparent from a careful reading of the included drawing figures, the claims and detailed description of the invention.

DESCRIPTION OF THE PREFERRED EMBODIMENT

Figure 2:
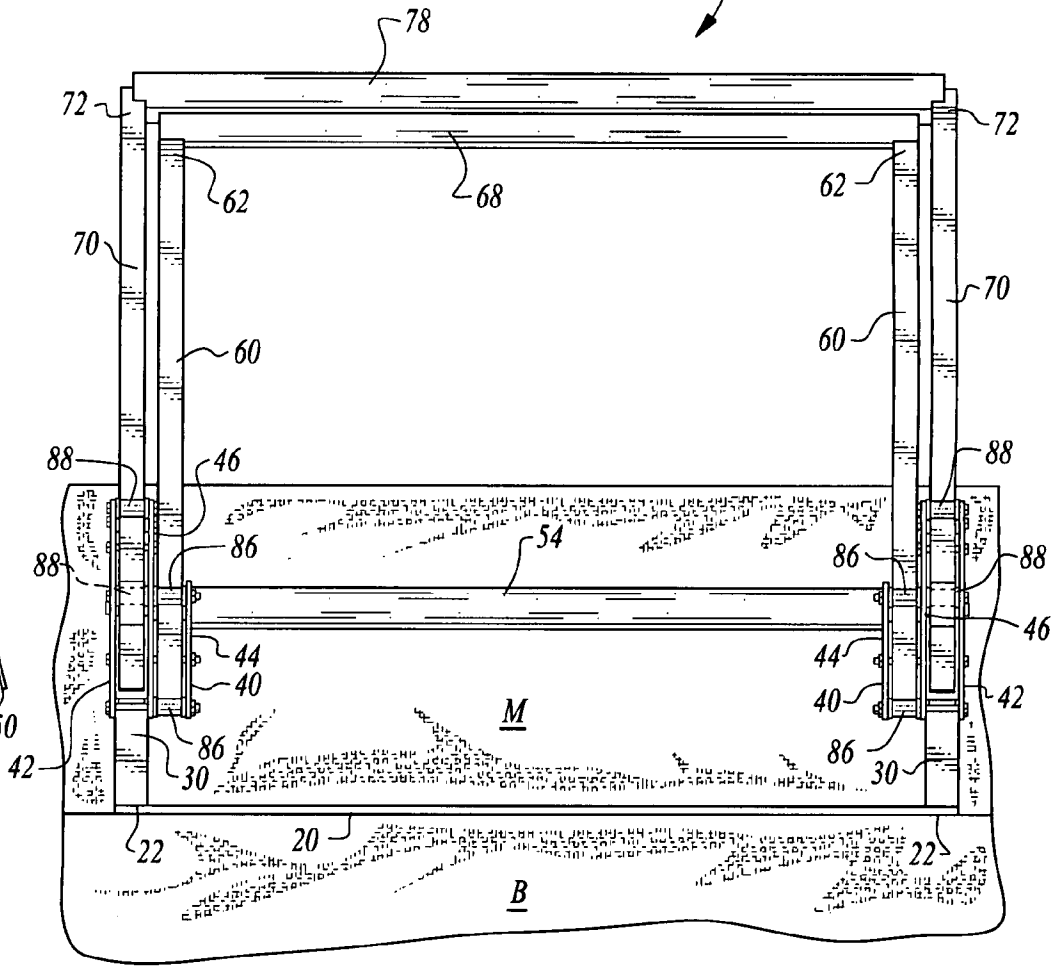
FIG. 2 is a rear elevation view of that which is shown in FIG. 1, and with the sheet removed to show details of the bed cover lift.

Referring to the drawings, wherein like reference numerals represent like parts throughout the various drawing figures, reference numeral 10 is directed to a bed cover lift (FIGS. 1-4). The lift 10 is configured to underlie bed covers, such as sheets S (FIG. 1) and raise the sheets S up sufficient to provide a clearance space in which feet F of a user can reside with toes pointing upwardly, while the user is resting upon a mattress M. The lift 10 is preferably supported with a base plate 20 beneath a mattress M and above a box spring B, or other support underlying the mattress M, so that the lift 10 can be readily positioned adjacent a foot of a bed and provide the desired clearance space over the feet F of the user.

In essence, and with particular reference to FIGS. 1-4, basic details of the bed cover lift 10 of this invention are described according to a preferred embodiment. The lift 10 is supported by a base, preferably in the form of a base plate 20. Columns 30 extend up from corners of the base plate 20 so that the columns 30 are adjacent a foot of the bed when the base plate 20 is located between the mattress M and an underlying support for the mattress M, such as a box spring B. Brackets 40 are provided on upper ends of each column 30, with there being preferably two columns 30 extending upwardly from left and right corners of the base plate 20. These brackets 40 are preferably spaced apart by an overall width of the lift 10, such as approximately the width of a single person bed or approximately half of a width of a two person bed. A clip 50 is coupled to the brackets 40 or otherwise coupled to the lift 10 which can hold foot ends of the sheet S and other bed covers adjacent the foot end of the bed. With the clip 50, the sheets S and other bed covers do not need to be tucked under the mattress M.

A pair of first arms 60 are coupled to the brackets 40 in a movable fashion relative to the brackets 40. A tip rod 68 joins upper ends 62 of the two first arms 60 together. This tip rod 68 is that portion of the elongate first arms 60 which comes into contact with the sheet S or other bed covers. The first arms 60 preferably move relative to the brackets 40. In one embodiment, such movement is facilitated by extending a driver 54 between the brackets 40 with shaft ends 56 (FIG. 11) supporting drive gears 82 which interface with rack gears 65 to lift the first arms 60. Second arms 70 are also coupled to the brackets 40 preferably in a movable fashion with corresponding drive gears 84 on shaft ends 56 and corresponding rack gears 75. The first arms 60 and second arms 70 are preferably each curved, but with a different amount of curvature. In this way, the first arms 60 and second arms 70 are generally adjacent to each other and the shaft ends 56 adjacent the brackets 40, but the upper ends 62 of the first arms 60 and top ends 72 of the second arms 70 are spaced laterally from each other when fully elevated to the raised position (FIGS. 1 and 2) due to this difference in curvature. A roller rod 78 preferably joins top ends 72 of each second arm 70 together, with the roller rod 78 defining that portion of the second arms 70 which come into contact with the sheet S or other bed covers.

The driver 54 can be configured to be biased towards exerting a force to lift the arms 60, 70. Then a latch can be provided to hold the arms 60, 70 in their lowered positions. When this latch or other driver disabler is actuated, the arms 60, 70 are released and the driver 54 acts to raise the arms 60, 70 from the lowered position to the raised position. The arms 60, 70 can be returned to their lowered position by merely pushing down on one of the arms 60, 70 or associated rods 68, 78 until the arms 60, 70 have returned to their lowered positions. The arms 60, 70 can then be held in the lowered positions by appropriate actuating of the latch or other driver disabler.

More specifically, and with particular reference to FIGS. 1-4, 7, 9 and 10, basic details of the base plate 20 and columns 30 are described, according to this preferred embodiment. The base plate 20 provides a preferred form of base for the overall lift 10. The base plate 20 is preferably in the form of a planar rigid structure which is sufficiently thin to fit beneath a mattress M and above a box spring B or other support beneath the mattress M without significantly altering the orientation of the mattress M away from a horizontal orientation. The base plate 20 is sized sufficiently large so that forces exerted upon the lift 10 can be absorbed by the base plate 20 through weight of the mattress M resting on the base plate 20, so that the entire lift 10 remains in a stable fixed position when the base plate 20 is inserted between the mattress M and box spring B.

The base plate 20 can be weighted or increased in size as necessary to provide appropriate rigidity and stability to the overall lift 10. As an alternative, the base plate 20 could be replaced with an attachment mechanism to allow a base structure (or the brackets 40) to be mounted directly to a foot board of the bed, or such an alternative base could be mounted directly to pedestals or other bed supports underneath the bed. As another alternative, the entire lift 10 could be built up off of the floor or mounted to a wall adjacent the bed.

Figure 7:
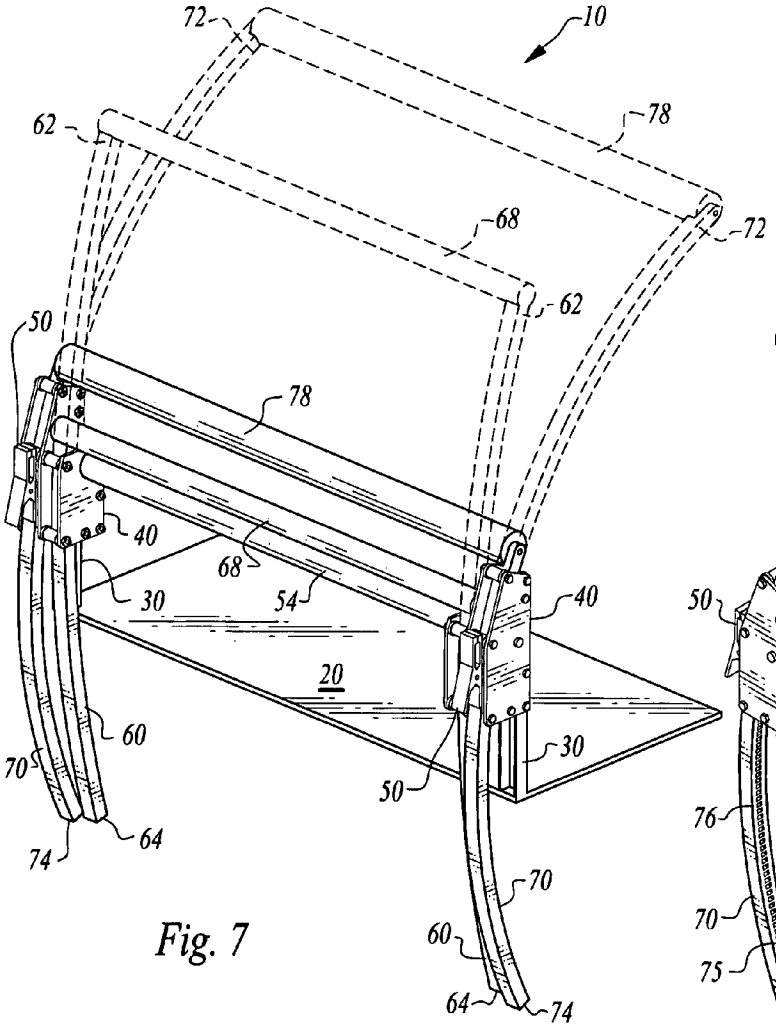
FIG. 7 is a perspective view of the lift of this invention along with an associated base plate and columns and illustrating the arms of the lift in a lowered position and with the arms in a raised position shown in broken lines.
Figures 9, 10, 11:
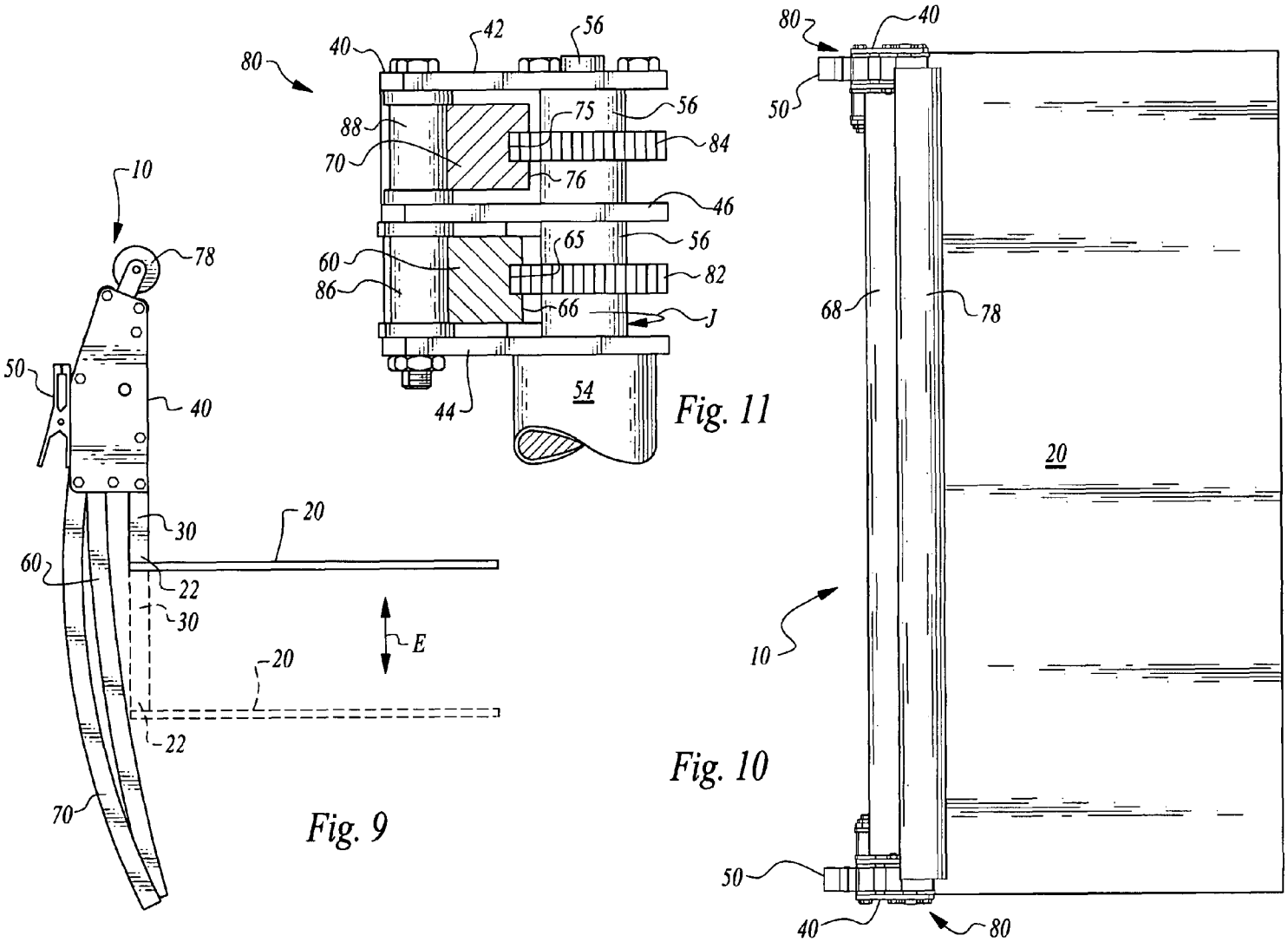
FIG. 9 is an opposite side elevation view of the lift of this invention and illustrating how a base plate and columns of this invention can be configured to be adjustable to accommodate mattresses of different thicknesses.
FIG. 10 is a top plan view of that which is shown in FIG. 3.
FIG. 11 is a top plan view of a single gear set and bracket assembly defining a portion of this invention and illustrating how the driver, output shaft and spur gears interact with rack gears and the elongate arms to raise and lower the elongate arms.

In this preferred embodiment, the base plate 20 is preferably substantially rectangular (FIGS. 7 and 10) and fixed to a pair of columns 30 which extend upward from rear corners of the base plate 20. These columns 30 are preferably fixed to the base plate 20, such as shown in FIG. 7. As an alternative, and as shown in FIG. 9, the columns 30 can be adjustably attached to the base plate 20. With such adjustability (along arrow E of FIG. 9) mattresses M (FIGS. 1-4) can be accommodated having different thicknesses. The columns 30 are preferably rigid structures which extend perpendicularly in a vertical direction up from the rear corners of the base plate 20. Where the columns 30 join to the base plate 20, rear joints 22 are provided. These joints should be strengthened and stiffened as necessary to allow for proper transfer of loads between the base plate 20 and columns 30.

Figure 1:
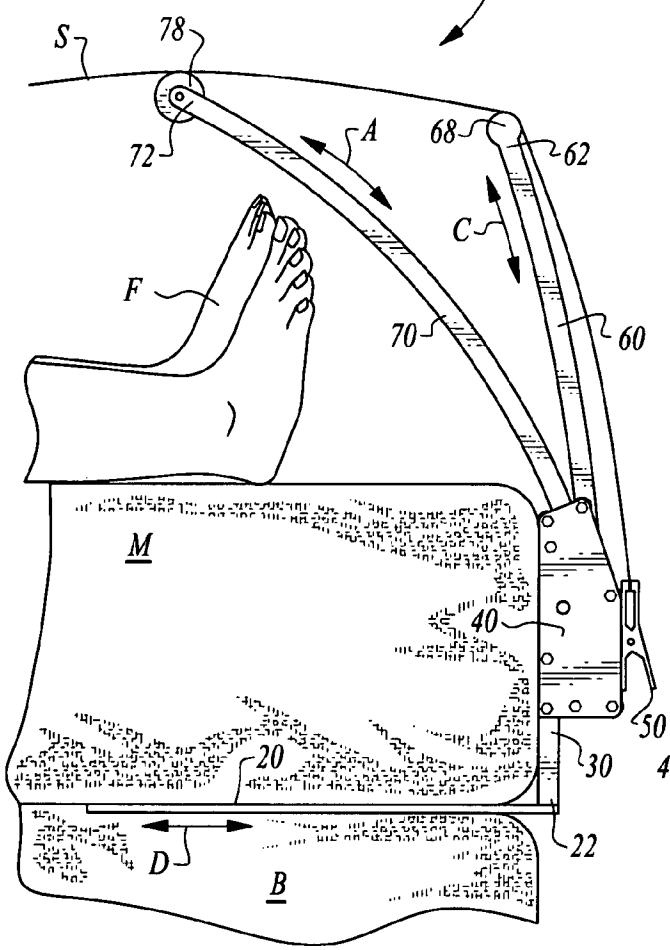
FIG. 1 is a side elevation view of the bed cover lift of this invention shown in a raised position elevating bed covers above a clearance space over a mattress.

With particular reference to FIGS. 1, 2 and 11, details of the brackets 40 are described according to this preferred embodiment. The brackets 40 provide an interface between the base structure including the base plate 20 and columns 30 and the movable elongate arms 60, 70. These brackets 40 are preferably provided as a pair with a left bracket 40 and right bracket 40 which are mirror images of each other, such that the overall lift 10 is substantially bilaterally symmetrical.

Each bracket 40 includes an outer plate 42 parallel with and spaced from an inner plate 44, and with a central plate 46 at a midpoint between the outer plate 42 and inner plate 44. Each of these plates 42, 44, 46 are preferably mutually parallel with each other and are each substantially planar and spaced from each other by similar widths. Each of the plates 42, 44, 46 are configured with holes with associated bolts passing through the holes to support gears or rollers, or to support standoffs which keep the plates 42, 44, 46 of the brackets 40 spaced from each other.

The brackets 40 also preferably support the clip 50 on a rear side of each bracket 40. The clip 50 is configured to grip a foot end of a sheet S or other bed covers adjacent the foot end of the bed. The clip 50 advantageously decreases the amount of sheet S area and other bed cover area required to secure the sheet S and other bed covers adjacent the foot of the bed. In particular, in the prior art, typically sheets S and other bed covers are tucked beneath the mattress M, requiring perhaps twelve inches or more of additional material to be tucked beneath the mattress and secure the sheets S and other bed covers adjacent the foot of the bed. When the sheets S and other bed covers are lifted by the lift 10 of this invention, additional sheet material is required to keep the foot end of the bed closed. This additional material is provided according to this invention by having the sheets S and other bed covers attach through the clips 50, rather than requiring the sheets S and other bed covers to be tucked beneath the mattress M.

The clip 50 can be elevated higher if it is desired to have the clearance area be open at the foot end of the bed. As another alternative, the clip 50 can be configured to keep the sheet S and other bed covers tightly adjacent the mattress M so that no air circulation is facilitated adjacent this clearance space. Clips 50 of various different configurations can be provided, and as an alternative, some form of fastener can be utilized with the sheet S potentially modified to form one portion of such a fastening system (e.g. velcro fasteners, buttons, zippers or tie strings).

Figure 4:
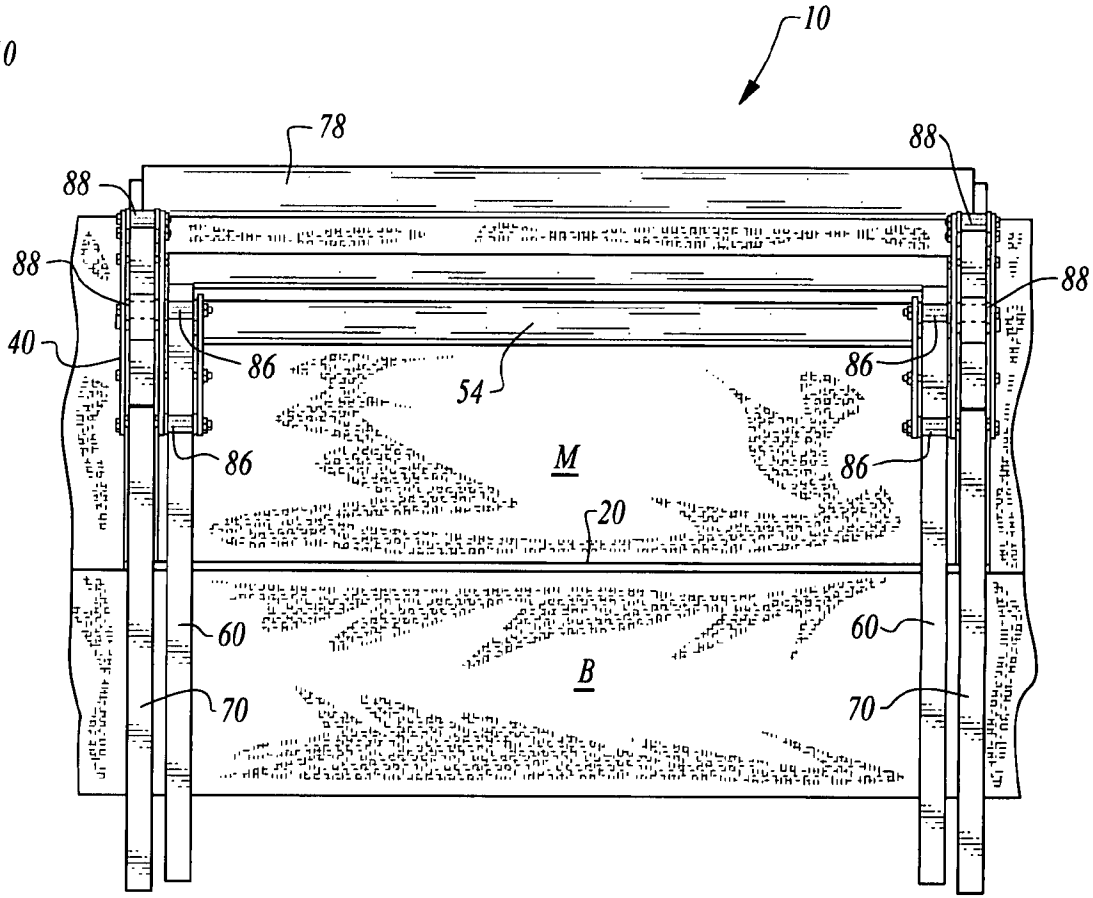
FIG. 4 is a rear elevation view of that which is shown in FIG. 3.

With particular reference to FIGS. 2, 4 and 11, details of the driver 54 of this invention are described, according to this preferred embodiment. The driver 54 is preferably in the form of a torsion spring, similar to a spring which might be provided within a roller shade. Preferably, a damper is also included within an outer housing defining this driver 54. This damper can be a highly viscous fluid, so that movement of a central drive shaft within the driver 54 is restrained by the damper and motion of the output shaft for the driver 50 is kept at a very slow rate. Shaft ends 56 of this output shaft extend out each end of the driver 54 to interface with drive gears 82, 84 of the gear set 80 (FIG. 11) for use in raising and lowering the arms 60, 70 as described in detail below. One suitable prior art driver to provide the driver 54 is described in U.S. Publication No. 2009/0025181, incorporated herein by reference.

As an alternative, the driver 54 could be in the form of an electric motor with a pair of output shafts routed to each of the drive gear sets 80 within each of the brackets 40. As another alternative, the driver 54 could be in the form of a series of weights suspended from lines wrapped about a rotating cylinder generally in the same shape as the driver 54 depicted in FIGS. 2, 4, 7, 8 and 11. As an alternative to weights, extension springs could be coupled to lines wrapped around cylindrical rollers shaped similar to the cylindrical driver 54 depicted herein.

In each of these embodiments, the driver 54 generally is configured to be biased towards a configuration where the arms 60, 70 are in a raised configuration. When the arms 60, 70 are pushed into their lowered position, the driver stores energy which can then be released to again raise the arms 60, 70.

A driver disabler or other latch is provided to hold the arms 60, 70 in their lowered position. For instance, a latch can be in the form of a hook that can releasably interface with a portion of each arm 60, 70 or the rods 68, 78 and anchored to the brackets 40, to hold the arms 60, 70 in their lowered position. As an alternative, a pawl or other latch could interface with at least one of the gears 82, 84 on at least one of the two shaft ends 56 to resist motion of the gear set 80 and motion of the arms 60, 70 unless such a disabler is deactivated.

While the disabler would typically be deactivated by pushing of a lever or pushing of a button, or flipping of some form of mechanical switch, as an alternative a servo motor could be utilized or another form of electronic switch which could be utilized which could be either placed adjacent the lift 10 or could operate through remote control technology. For instance, a user might have a remote control switch at a nightstand adjacent a head of the bed. The user could push a button on such a remote control to cause the driver disabler to be deactivated and to cause the lift 10 to lift the sheets S and other bed covers up to create the clearance space. If an electric motor is provided as the driver 54, a separate switch could also be provided for lowering of the sheets S or other bed covers. Conceivably, the sheets S could be height adjustable to a height selected by the user with such a system by merely selecting higher or lower inputs through such a remote control to be interpreted by the electric motor, until the sheets S and other bed covers are positioned where desired.

With particular reference to FIGS. 1-8, details of the elongate arms including the pair of first arms 60 and pair of second arms 70 are described, according to this preferred embodiment. In a simplest form of this invention, as few as merely one single elongate arm could be provided to extend from a lowered position to a raised position and lift portions of a sheet S or other bed covers up off of a mattress M when the elongate arm is transitioned to the raised position.

In this most preferred embodiment, a pair of first arms 60 are provided as well as a pair of second elongate arms 70. The first elongate arms 60 each are similar in form and extend from an upper end 62 to a lower end 64. An inner side 66 is fitted with a rack gear 65 substantially from the upper ends 62 to the lower end 64. A tip rod 68 joins the upper end 62 of the first elongate arms 60 together. This tip rod 68 is preferably fixed in form but could be fitted with a roller as with the second elongate arm 70.

Figure 3:
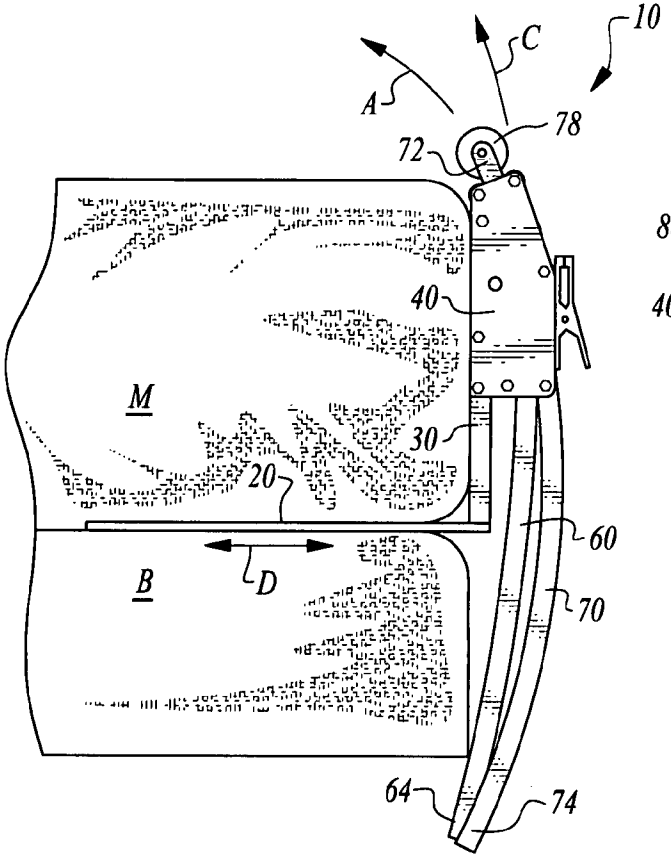
FIG. 3 is a side elevation view similar to that which is shown in FIG. 1 but with elongate, arms associated with the lift in the lowered position.
Figure 5:
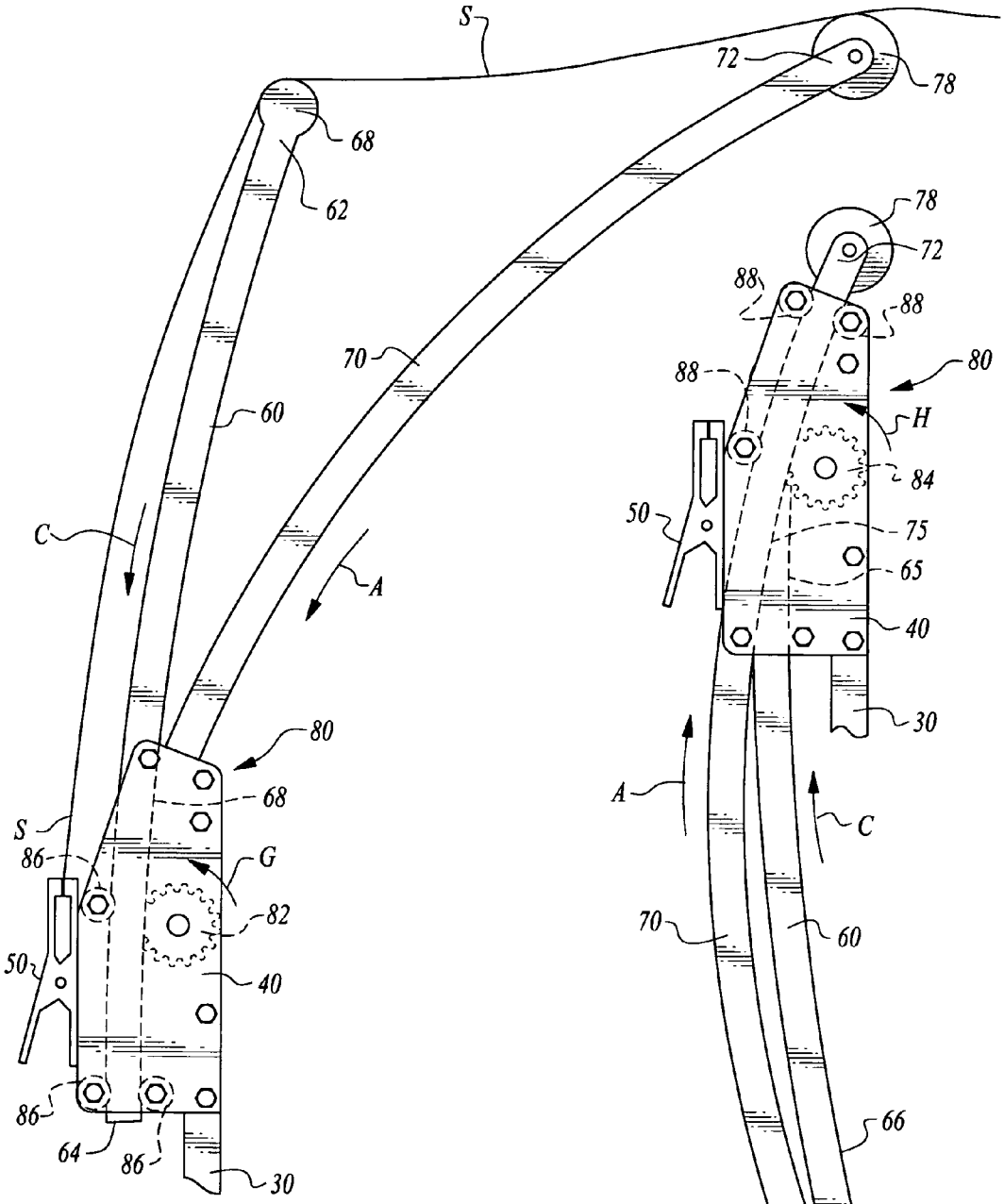
FIG. 5 is an opposite side elevation view of the lift of this invention with a bed cover overlying the lift and with elongate arms of the lift in a raised position, and with portions of the elongate arms hidden by brackets shown in broken lines, as well as associated gears to illustrate operation of the lift of this invention.
Figure 6:
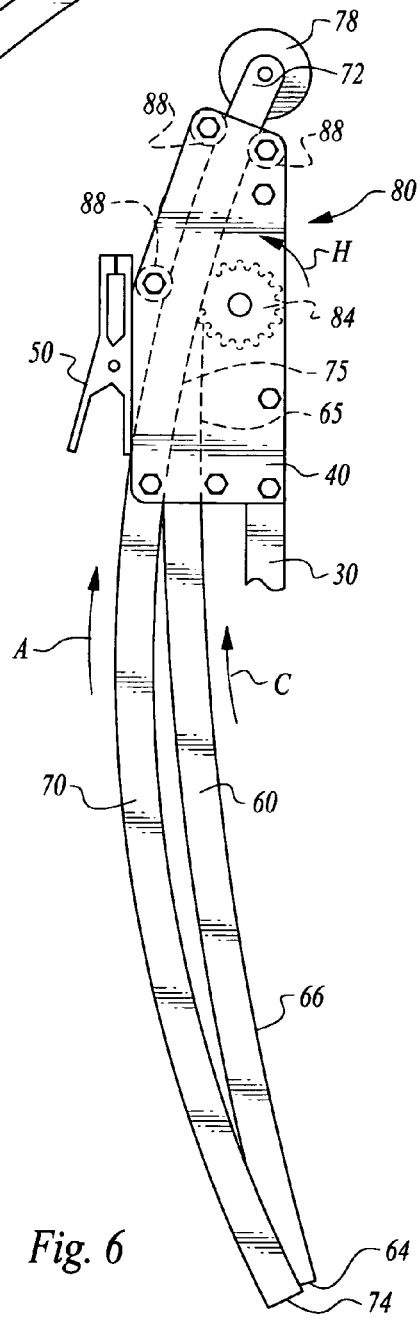
FIG. 6 is an opposite side elevation view similar to that which is shown in FIG. 5, but with each of the elongate arms in a lowered position.
Figure 8:
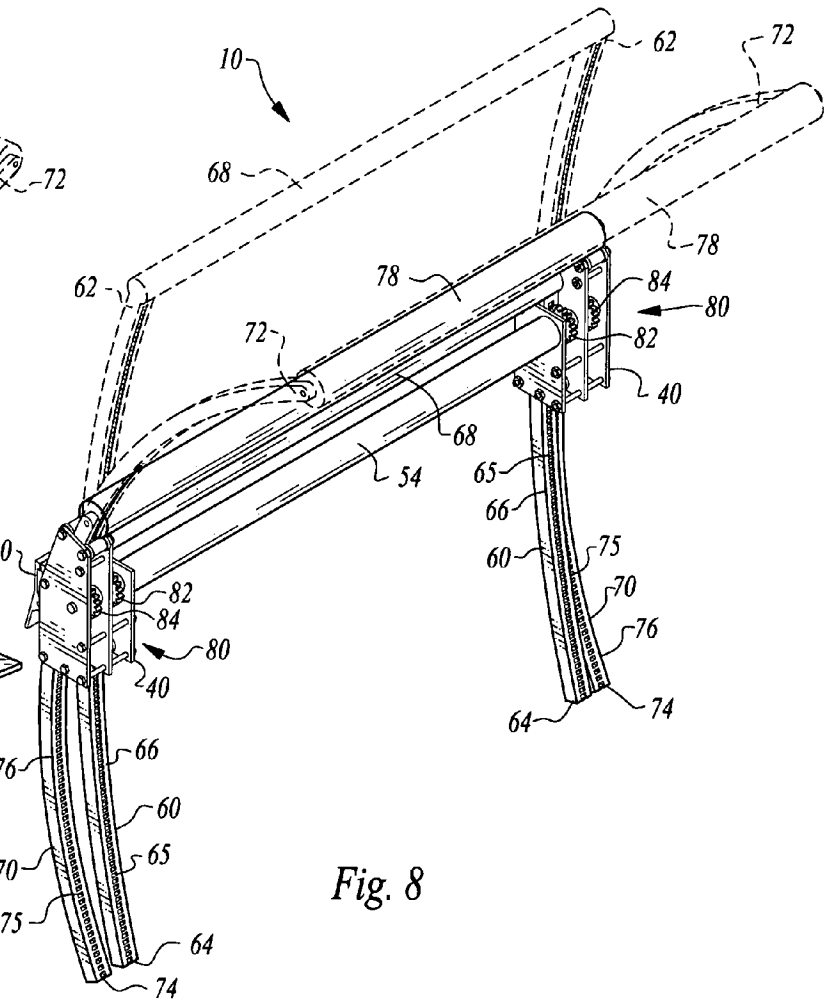
FIG. 8 is a perspective view similar to that which is shown in FIG. 7 but with a more frontward viewing angle and with the base plate and columns removed to show additional detail of brackets and the gear set'associated with the driver.

The first elongate arms 60 preferably have a substantially rectangular cross section (FIG. 11). The first elongate arms 60 could be linear in form, but preferably are slightly curved in a manner similar to that depicted in FIGS. 1, 3 and 5-9. Movement of the first elongate arm 60 occurs along arrow C (FIGS. 1 and 3). Such movement occurs by action between the first arm drive gear 82 (FIGS. 8 and 11) along with the rack gear 65 (FIGS. 8 and 11). This action is also depicted in broken lines in FIG. 5. The first arms 60 are held in position, except for translation along arrow C, by utilization of first arm guide rollers 86 at strategic locations between separate plates 44, 46 of the brackets 40. The first arms 60 are preferably on a more inboard portion of the brackets 40 than are the second arms 70.

The second elongate arms 70 are similar to the first elongate arms 60 in many respects, including a top end 72 opposite a bottom end 74 and with an inner side 76 fitted with the rack gear 75 thereon. Preferably, the second elongate arms 70 include a roller rod 78 which extends horizontally between the top end 72 of the second elongate arms 70 to join them together at this upper end. The second elongate arms 70 preferably reside between the outer plates 42 and central plates 46 of the brackets 40. The second arms 70 are caused to be raised and lowered by action of the second arm drive gear 84 (FIGS. 6, 8 and 11) with the rack gear 75 on the second elongate arm 70. Such action then causes this second elongate arm 70 to move along arrow A of FIGS. 1, 3, 5 and 6).

Preferably, the second elongate arms 70 are more curved than the first elongate arms 60. Also, the orientation of the second arms 70 adjacent the brackets 40 are angled to a greater extent than that of the first arms 60. In this way, when the arms 60, 70 are each moved from the lowered position to the raised position, the top end 72 of the second arm 70 extends more forward toward a head of the bed than to the upper end 62 of the first arms 60. In this way, a larger overall clearance space is provided beneath the sheet S, held up by the upper ends 62 of the first arms 60 and top ends 72 of the second arms 70. In essence, four points of support are provided by the extra curving the second arms 70. Second arm guide rollers 88 are provided adjacent the brackets 70 and the second arms 70 to keep the second arm 70 precisely positioned where desired and limiting motion of the second arms 70 relative to the brackets 40 to translation along the arc defined by arrow A.

When the driver 54 shaft ends 56 rotate (about arrow J of FIG. 11), this rotation causes the drive gears 82, 84 to also rotate (about arrow J of FIG. 11). Each shaft end 56 of the driver 54 is caused to rotate a similar amount and each of the drive gears 82, 84 is caused to rotate at a common rate. However, the number of teeth and the diameter of the drive gears 82, 84 are slightly different from each other. Furthermore, the spacing of gears within the rack gear 65 and rack gear 75 are preferably slightly different from each other. These gear ratios are set overall to cause the upper end 62 of the first arm 60 and the top end 72 of the second arm 70 to all move upwardly (along arrows A and C of FIGS. 1, 3 and 5) at a common rate. Thus, even though the second elongate arms 70 extend more diagonally than do the first elongate arms 60, a similar number of turns of the shaft ends 56 of the driver 54 cause a greater linear portion of the second elongate arms 70 to be advanced by the second arm drive gear 84 than the corresponding amount of movement by the first arms 60, while a height of the top end 72 of the second arm 70 remains similar to a height of the upper end 62 of the first arms 60. In this way, an elevation of the clearance space above the mattress M between the tip rod 68 and roller rod 78 is substantially horizontal. Rotation of the first drive gear is also depicted along arrow G of FIG. 5. Rotation of the second drive gear is also depicted by arrow H of FIG. 6.

The lift 10 is preferably configured so that it can be removably attached to the bed. When the lift 10 is desired to be used on another bed or to no longer be placed in use, it can be translated horizontally (along arrow D of FIGS. 1 and 3) for removal of the lift 10 from the bed. Similarly, when the lift 10 is to be attached to a bed, the lift 10 is moved (along arrow D of FIGS. 1 and 3) to fit the base plate 20 between the mattress M and underlying box spring B, until the bracket 40 is directly adjacent a foot end of the mattress M. The lift 10 is then ready for use such as by placement of sheets S and bed covers over the lift 10, and securing of the sheet S and bed covers to the clip 50.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A bed cover lift, comprising in combination:

a base;

said base adapted to be supported by a bed adjacent a foot of the bed;

at least one elongate arm coupled to said base;

said arm having an upper end adapted to support a bed cover;

said at least one arm adapted to move relative to said base to move said upper end of said arm from a lowered position to a raised position with said raised position lifting bed covers adjacent the upper end higher than when said arm is in said lowered position;

wherein at least two elongate arms are coupled to said base, said at least two elongate arms oriented substantially parallel to each other and spaced from each other, said at least two elongate arms each including upper ends joined together by an elongate element adapted to be located below a bed cover adjacent a foot of a bed, said elongate element maintaining a substantially horizontal orientation both when said arms are in said lowered position and in said raised position;

wherein said at least two elongate arms are a first pair of arms and wherein a second pair of elongate arms are provided parallel with each other and spaced from each other by a second elongate element extending substantially horizontally between said second pair of elongate arms; and wherein both said first pair of elongate arms and said second pair of elongate arms are each driven by a common driver, said driver adapted to move said pairs of arms between said lowered position and said raised position.

2. The lift of claim 1 wherein a driver is coupled to said at least one arm, said driver adapted to move said arm between said lowered position and said raised position.

3. The lift of claim 2 wherein said driver includes a spring, said spring adapted to transition between an energy stored configuration and an energy released configuration, said energy released configuration corresponding with when said arm is moved from said lowered position to said raised position.

4. The lift of claim 3 wherein said driver includes a damper, said damper adapted to cause energy from said spring to be released by said driver to said arm slower than such energy release would be without said damper.

5. The lift of claim 1 wherein said base includes a substantially planar plate adapted to fit in a substantially horizontal plane between a mattress of the bed and an underlying mattress support of the bed with portions of said plate adjacent the foot of the bed.

6. The lift of claim 1 wherein a cover clip is coupled to said base, at least indirectly, said cover clip adapted to hold a foot end of bed covers adjacent the foot of the bed, to resist lifting of the foot end of the covers away from the bed.

7. The lift of claim 1 wherein each of said arms curve from a lower end to an upper end, with said second pair of arms curving more than said first pair of arms and with said first pair of arms and said second pair of arms located adjacent each other adjacent the output shaft of said driver, but with said first pair of arms spaced from said second pair of arms at upper ends thereof opposite said output shaft of said driver, such that an enlarged clearance space is provided when said arms are located below a bed cover and above a mattress.

8. The lift of claim 1 wherein each of said arms includes a rack gear thereon, and wherein said driver includes output shafts at opposite ends thereof, said driver being elongate and similar in length to each of said elongate elements joining said pairs of arms together, said output shafts including spur gears thereon configured to enmesh with said rack gears on said arms, such that when said driver causes said output shaft of said driver to rotate, each of said arms is caused to translate by action of said rack gears on said arms with said spur gears on said output shaft of said driver.

9. A tool for supporting bed covers above a mattress, to maintain a clearance space above the mattress and below the covers adjacent the foot of the bed, comprising in combination:

a base;

said base adapted to be fixed in position relative to the mattress;

at least two elongate arms coupled to said base, said elongate arms each having distal ends adapted to be positioned beyond said base, beneath the bed covers and overlying the mattress;

said at least two elongate arms oriented substantially parallel to each other at least two elongate arms are coupled to said base, said at least two elongate arms oriented substantially parallel to each other and spaced from each other, said at least two elongate arms each including upper ends joined together by an elongate element adapted to be located below a bed cover adjacent a foot of a bed, said elongate element maintaining a substantially horizontal orientation both when said arms are in said lowered position and in said raised position;

wherein said at least two elongate arms are a first pair of arms and wherein a second pair of elongate arms are provided parallel with each other and spaced from each other by a second elongate element extending substantially horizontally between said second pair of elongate arms; and wherein both said first pair of elongate arms and said second pair of elongate arms are each driven by a common driver, said driver adapted to move said pairs of arms between said lowered position and said raised position.

10. A method for lifting bed covers adjacent a foot of a bed, to provide a clearance space above a mattress of the bed and below the bed covers, the method including the steps of:

providing a base; the base adapted to be supported by a bed adjacent a foot of the bed; at least one elongate arm coupled to the base; the arm having an upper end adapted to support a bed cover; and the at least one arm adapted to move relative to the base to move the upper end of the arm from a lowered position to a raised position with the raised position lifting the bed covers adjacent the upper end higher than when the arm is in the lowered position;

positioning the base adjacent the foot of the bed with the upper end of the at least one elongate arm under the bed covers;

moving the at least one elongate arm from the lowered position to the raised position, in a manner causing the bed covers to be raised adjacent the foot of the bed;

wherein said providing step further includes at least two elongate arms being coupled to the base, the at least two elongate arms oriented substantially parallel to each other and spaced from each other, the at least two elongate arms each including upper ends joined together by an elongate element adapted to be located below a bed cover adjacent a foot of a bed, the elongate element maintaining a substantially horizontal orientation both when the arms are in the lowered position and in the raised position;

wherein said providing step further includes the at least two elongate arms being a first pair of arms and wherein a second pair of elongate arms are provided parallel with each other and spaced from each other by a second elongate element extending substantially horizontally between the second pair of elongate arms; and wherein said providing step further includes both the first pair of elongate arms and the second pair of elongate arms each being driven by a common driver, the driver adapted to move the pairs of arms between the lowered position and the raised position.

11. The method of claim 10 including the further step of providing a driver coupled to the at least one elongate arm and adapted to move the at least one elongate arm between the lowered position and the raised position, the driver configured to include a spring and a damper, with said driver adapted to be disabled to keep the at least one elongate arm in the lowered position until the driver is released by releasing the disabler, and allowing the spring of the driver to transfer energy to the at least one elongate arm to raise the at least one elongate arm from the lowered position to the raised position.

12. The method of claim 10 including the further step of attaching a foot end of the bed covers to the bed adjacent the foot of the bed through a fastener coupled to the base.

13. The method of claim 10 including the further step of providing a driver coupled to the at least one arm with the driver adapted to move the at least one arm between the lowered position and the raised position;

initially positioning the at least one elongate arm in the lowered position; and activating the driver to lift the at least one arm and lift the bed covers above the at least one arm to create the clearance space above the mattress of the bed.

* * * * *